US008814068B2

(12) United States Patent
Wu

(10) Patent No.: US 8,814,068 B2
(45) Date of Patent: Aug. 26, 2014

(54) WATER SEPARATION STRUCTURE OF SHOWER HEAD STRUCTURE

(76) Inventor: Wei-Sheng Wu, New Taipei (TW)

( * ) Notice: Subject to any disclaimer, the term of this patent is extended or adjusted under 35 U.S.C. 154(b) by 523 days.

(21) Appl. No.: 13/298,242

(22) Filed: Nov. 16, 2011

(65) Prior Publication Data

US 2013/0119164 A1 May 16, 2013

(51) Int. Cl.
*A62C 37/20* (2006.01)
*B05B 1/16* (2006.01)
*B05B 1/18* (2006.01)

(52) U.S. Cl.
CPC ..... *B05B 1/18* (2013.01); *B05B 1/1654* (2013.01)
USPC ..... 239/563; 239/562

(58) Field of Classification Search
CPC ..... B05B 1/14; B05B 1/16; B05B 1/169
USPC ..... 239/548, 563, 553, 562, 526
See application file for complete search history.

(56) References Cited

U.S. PATENT DOCUMENTS

| | | | | |
|---|---|---|---|---|
| 6,113,002 | A * | 9/2000 | Finkbeiner | 239/106 |
| 6,241,166 | B1 * | 6/2001 | Overington et al. | 239/553.3 |
| 6,742,721 | B2 * | 6/2004 | Piper | 239/265.11 |
| 2007/0246577 | A1 * | 10/2007 | Leber | 239/589 |
| 2011/0000982 | A1 * | 1/2011 | Luettgen et al. | 239/548 |

* cited by examiner

*Primary Examiner* — Davis Hwu

(57) ABSTRACT

A water separation structure of a shower head includes a cover unit, a cover seal seat and a main body seal seat. The cover unit has three water outlets. Three water passages and a shift water passage are formed between the cover seal seat and the cover unit. The cover seal seat has five through holes. The main body seal seat has a water inlet and a blind hole which are spaced and located corresponding to the five through holes. The water inlet comprises a seal ring therein. The blind hole comprises a seal pad therein. The water inlet communicates with one of the five through holes by means of rotation to open the relative water passage. The blind hole is to block the other through holes and close the other water passages. The seal ring and the seal pad are against the cover seal seat.

6 Claims, 9 Drawing Sheets

WATER SEPARATION STRUCTURE OF SHOWER HEAD STRUCTURE

BACKGROUND OF THE INVENTION

1. Field of the Invention

The present invention relates to a shower head structure, and more particularly to a shower head having a water separation structure.

2. Description of the Prior Art

Nowadays, a shower head is an essential apparatus for taking a bath. An improved shower head is developed to have different spray modes, such as a swing spray mode, a massage spray mode, a bubble spray mode and the like. However, the conventional spray head adopts a single water passage to spray water. The water hole and water passage are mated one by one. As shown in FIG. 1 and FIG. 2, a water inlet 111 of a main body seal seat 11 corresponds in position to a water hole 121 of a cover seal seat 12. The cover seal seat 12 has a plurality of holes 121 to communicate with a plurality of water passages 131 of a cover unit 13.

The water passes each water hole of this structure only once. It needs many water passages for different spray modes. This structure is complicated and cannot be produced in a large scale. How to achieve different spray modes by means of the limited water passages is important. Accordingly, the inventor of the present invention has devoted himself based on his many years of practical experiences to solve these problems.

SUMMARY OF THE INVENTION

The primary object of the present invention is to provide a water separation structure of a shower head for providing different spray modes.

In order to achieve the aforesaid object, the separation structure of a shower head of the present invention comprises a cover unit, a cover seal seat and a main body seal seat.

The cover unit has three water outlets which are a first water outlet, a second water outlet and a third water outlet. The cover seal seat is connected to the cover unit. Three water passages and a shift water passage are formed between the cover seal seat and the cover unit. The three water passages are a first water passage which communicates with the first water outlet, a second water passage which communicates with the second water outlet and a third water passage which communicates with the third water outlet.

The cover seal seat has five through holes which are disposed in a circle. The five through holes are a first through hole which communicates with the first water passage, a second through hole which communicates with the second water passage, a third through hole which communicates with the third water passage, a first reverse flow hole and a second reverse flow hole. The shift water passage communicates with the first reverse flow hole and the second reverse flow hole.

The main body seal seat is connected to the cover seal seat in a rotatable way. The main body seal seat has a water inlet and a blind hole which are spaced and located corresponding to the five through holes of the cover seal seat. The water inlet comprises a seal ring therein. The blind hole comprises a seal pad therein. The water inlet communicates with one of the five through holes of the cover seal seat by means of rotation to open the relative water passage. The blind hole is to block the other through holes and close the other water passages. The seal ring and the seal pad are against the cover seal seat.

Seal members are provided between relative parts for water seal.

Preferably, the circumferential angle between the water inlet and the blind hole is equal to the circumferential angle of three of the five through holes. The water inlet and the blind hole respectively cover two spaced through holes. An interval between the water inlet and the blind hole covers the middle through hole.

Alternatively, the circumferential angle between the water inlet and the blind hole is equal to the circumferential angle of two of the five through holes. The water inlet and the blind hole respectively cover the two adjacent through holes.

Preferably, the water inlet and the blind hole each have a rim protruding from an outer edge thereof and a spring therein.

Preferably, the cover seal seat has a positioning hole thereon and the main body seal seat has five positioning recesses. The positioning hole is provided with a positioning pin which slides among the five positioning recesses.

Preferably, the cover unit is integrally formed with the cover seal seat.

Through the shift water passage formed between the cover seal seat and the cover unit of the present invention, the water enters the cover seal seat once again and flows to the unsealed through holes to achieve the mixed spray function. The present invention is simple in configuration and can be manufactured easily and may be applied to various structures for water outflow.

DETAILED DESCRIPTION OF THE PREFERRED EMBODIMENTS

Embodiments of the present invention will now be described, by way of example only, with reference to the accompanying drawings.

Figure 1:
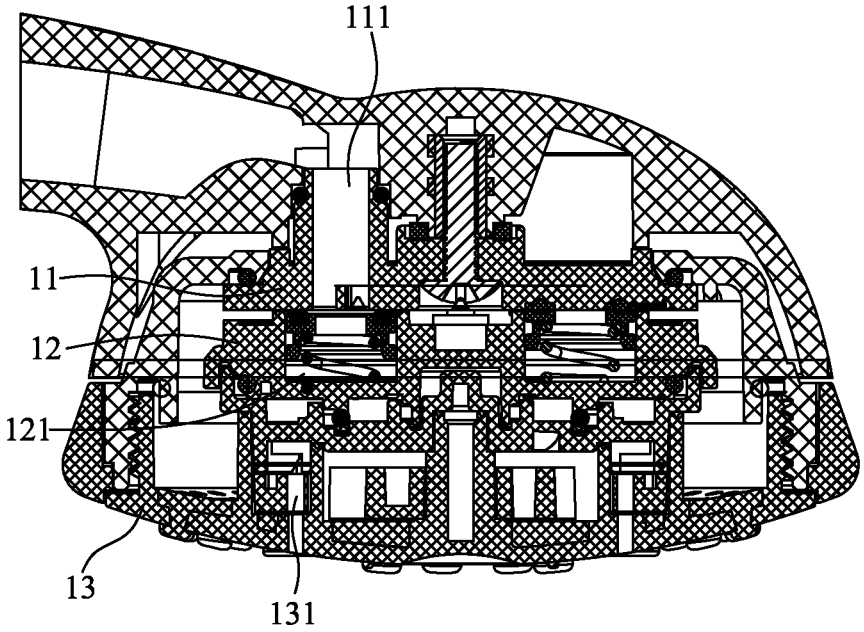
F I G. 1 Prior Art
FIG. 1 is a sectional view of a conventional shower head.
Figure 2:
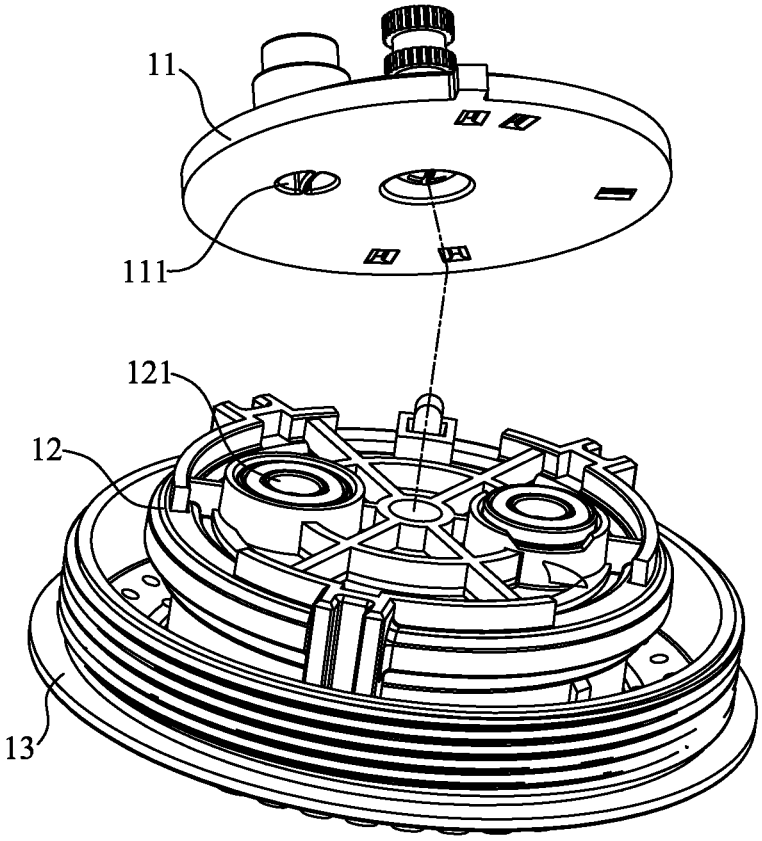
F I G. 2 Prior Art
FIG. 2 is an exploded view of the conventional shower head.
Figure 3:
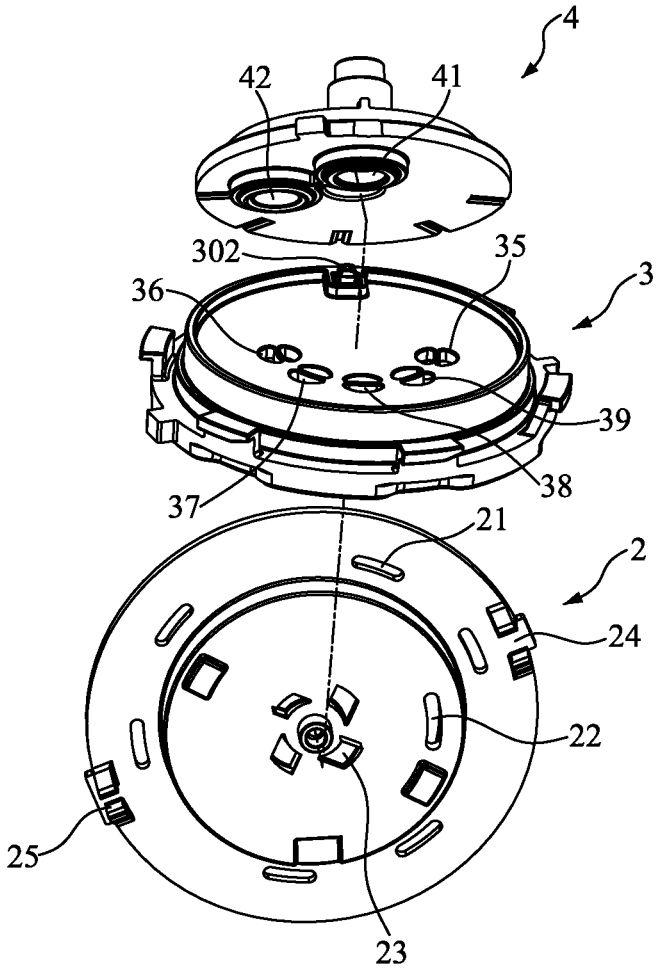
FIG. 3 is an exploded view of the present invention.

As shown in FIG. 3, the water separation structure of a shower head of the present invention comprises a cover unit 2, a cover seal seat 3 and a main body seal seat 4. The cover unit 2 has three outlets, namely, a first water outlet 21, a second water outlet 22 and a third water outlet 23.

Figure 4:
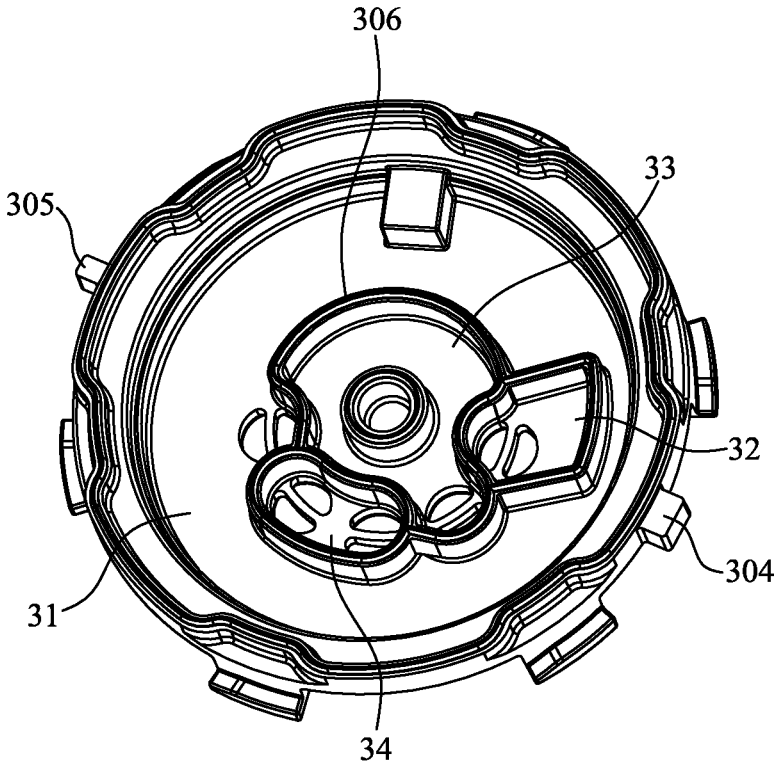
FIG. 4 is a perspective view showing the cover seal seat of the present invention.

The cover seal seat 3 is connected to the cover unit 2. As shown in FIG. 4, three water passages and a shift water passage 34 are formed between the cover seal seat 3 and the cover unit 2. The three water passages are a first water passage 31 which communicates with the first water outlet 21, a second water passage 32 which communicates with the second water outlet 22, and a third water passage 33 which communicates with the third water outlet 23. Preferably, the water passages are separated with a separating rib 306.

As shown in FIG. 3, the cover seal seat 3 has five through holes which are disposed in the same circle, namely, a first through hole 35 which communicates with the first water passage 31, a second through hole 36 which communicates with the second water passage 32, a third through hole 37 which communicates with the third water passage 33, a first reverse flow hole 38, and a second reverse flow hole 39. The shift water passage 34 communicates with the first reverse flow hole 38 and the second reverse flow hole 39 for the two reverse flow holes to form a flow passage.

Figure 5:
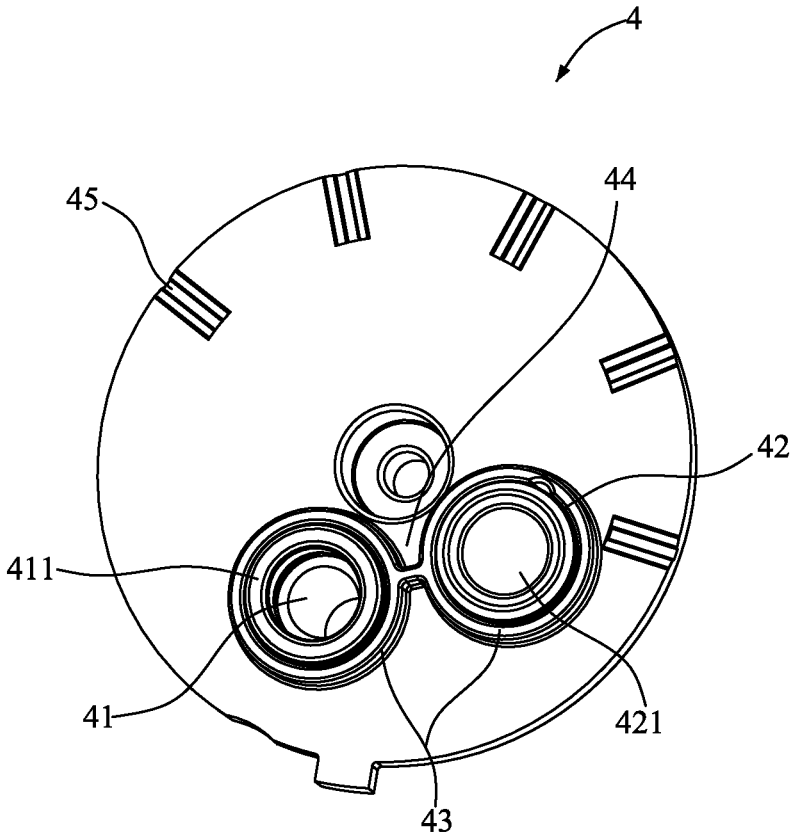
FIG. 5 is a schematic view showing the main body seal seat of the present invention.

The main body seal seat 4 is connected to the cover seal seat 3 in a rotatable way. As shown in FIG. 5, the main body seal seat 4 has a water inlet 41 and a blind hole 42 which are spaced and located corresponding to the five through holes of the cover seal seat 3. An interval 44 is defined between the water inlet 41 and the blind hole 42. The water inlet 41 comprises a seal ring 411 therein. The blind hole 42 comprises a seal pad 421 therein. The water inlet 41 communicates with one of the five through holes of the cover seal seat 3 by means of rotation to open the relative water passage. The blind hole 42 is to block the other through holes and close the other water passages. The seal ring 411 and the seal pad 421 are against the cover seal seat 3. The water inlet 41 and the blind hole 42 each have a rim 43 protruding from an outer edge thereof to enhance the seal effect. A spring 46 is placed in each of the water inlet 41 and the blind hole 42, and then the seal ring 411 and the seal pad 421 are placed in the water inlet 41 and the blind hole 42. Through the support of the protruding rim 43, the seal ring 411 and the seal pad 421 are tightly against the cover seal seat 3 by the spring 46.

Figure 6:
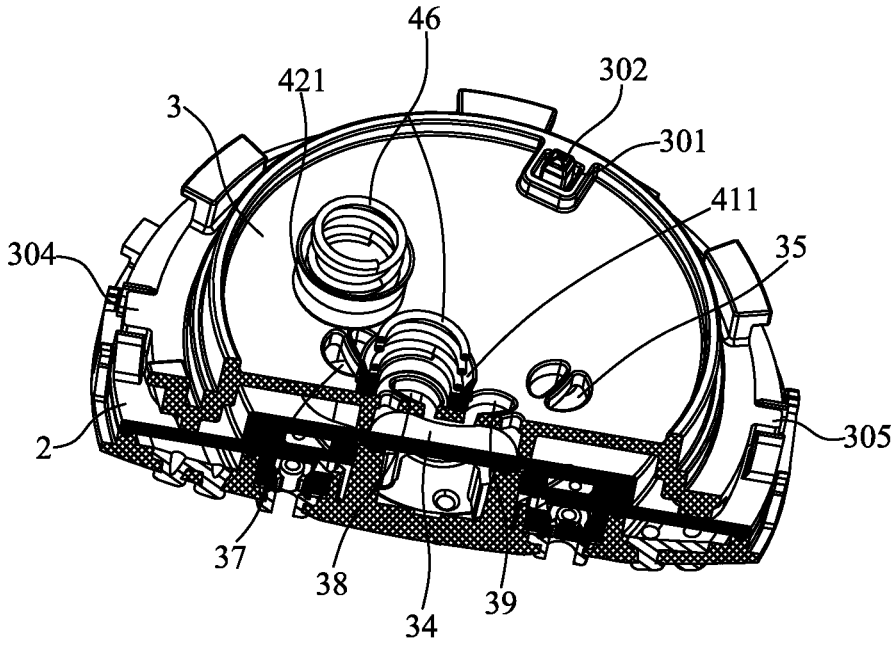
FIG. 6 is a schematic view showing a first embodiment of the present invention.

FIG. 6 shows a first embodiment of the present invention. The circumferential angle between the water inlet 41 and the blind hole 42 is equal to the total circumferential angle of three through holes. The water inlet 41 and the blind hole 42 respectively cover two spaced through holes, and the interval 44 between the water inlet 41 and the blind hole 42 covers the middle through hole.

Figure 7:
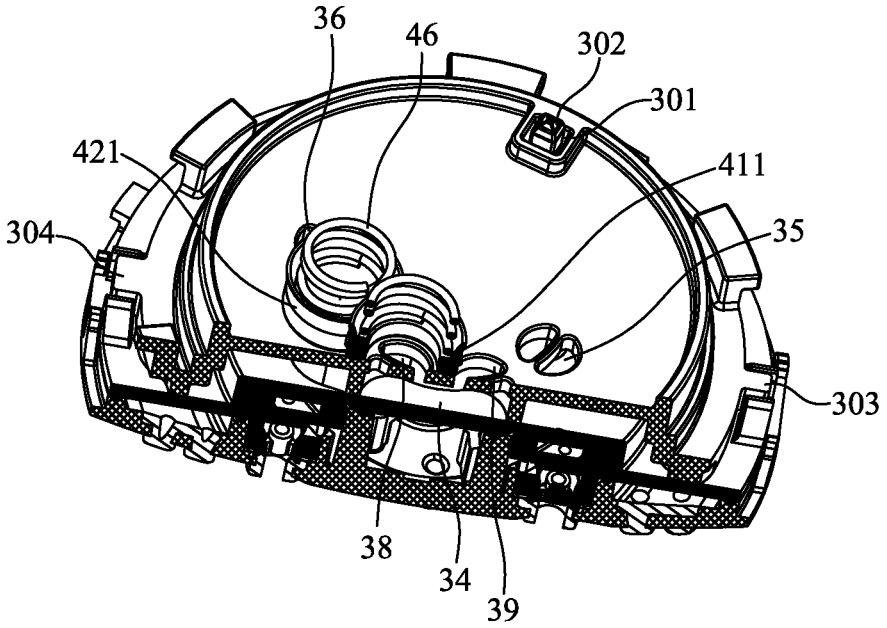
FIG. 7 is a schematic view showing a second embodiment of the present invention.

FIG. 7 shows a second embodiment of the present invention. The circumferential angle between the water inlet 41 and the blind hole 42 is equal to the total circumferential angle of two through holes. The water inlet 41 and the blind hole 42 respectively cover two adjacent through holes.

Figure 8:
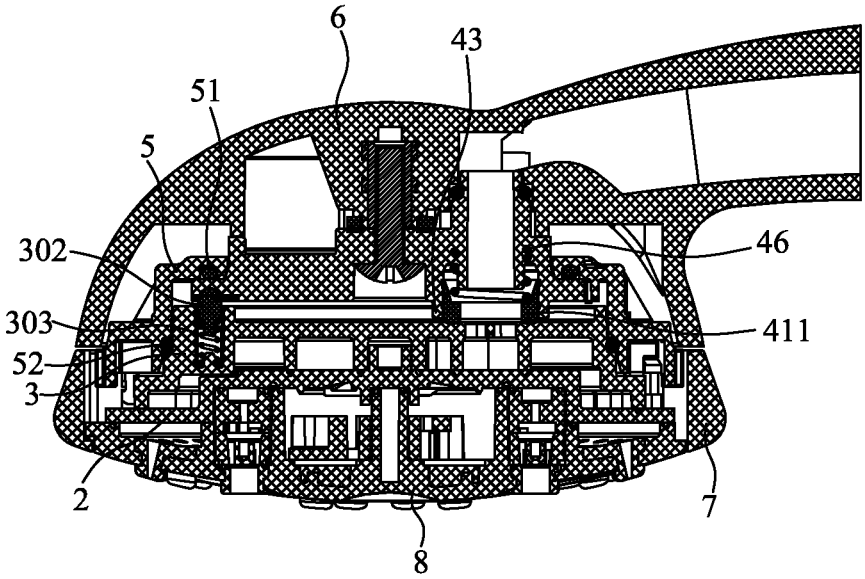
FIG. 8 is a sectional view of the shower head of the present invention.

As shown in FIG. 3, FIG. 5, and FIG. 8, the cover seal seat 3 has a positioning hole 301 thereon. The main body seal seat 4 has five positioning recesses 45. The positioning hole 301 is provided with a positioning pin 302 and a small spring 303. The positioning pin 302 is biased by the small spring 303 to be against the positioning recesses 45. When rotated, the positioning pin 302 slides among the five positioning recesses 45 for the user to know the switch is done.

Figure 9:
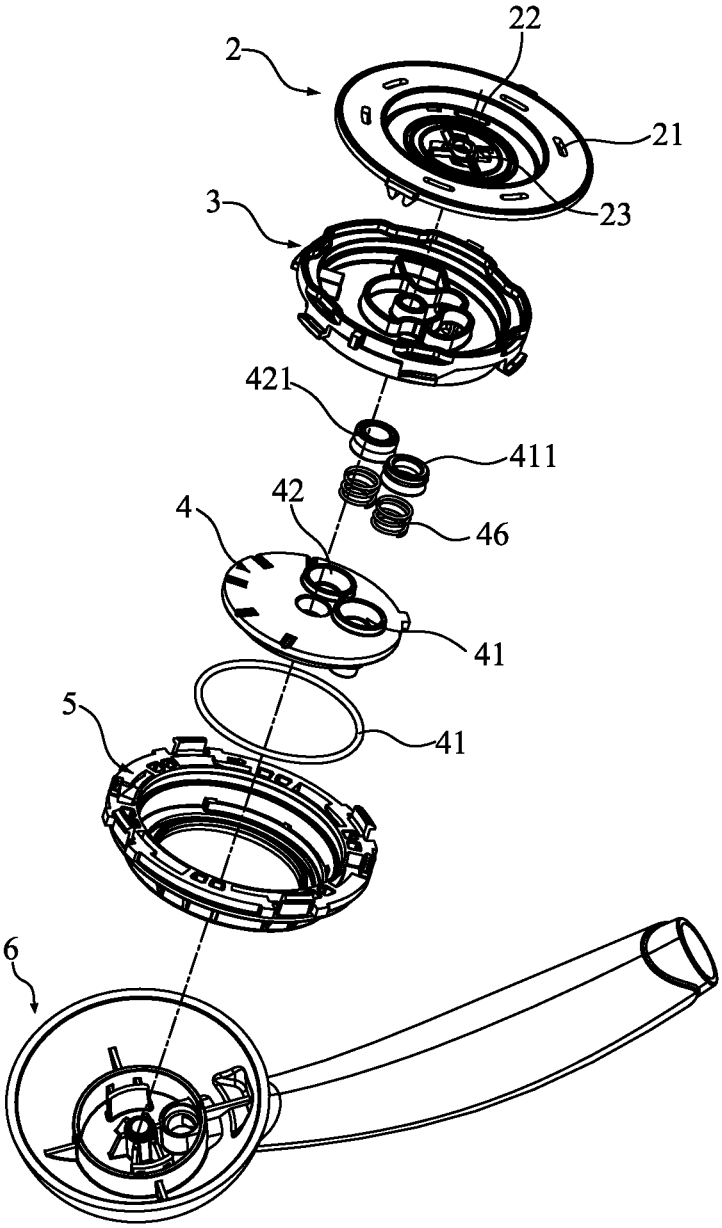
FIG. 9 is an exploded view of the shower head of the present invention.

As shown in FIG. 6, FIG. 7, and FIG. 9, for the cover seal seat 3 to be fixed to the cover unit 2 and the match of the three outer outlets and the three water passages, the cover seal seat 3 has a thick rib 304 and a thin rib 305 thereon and the cover unit 2 has a big limit slot 24 and a small slot 25 thereon. The thick rib 304 is engaged in the big limit slot 24, and the thin rib 305 is engaged in the small limit slot 25.

Referring to FIG. 8 and FIG. 9, the present invention is installed in a shower head. In the first embodiment, the shower head further comprises a rotation seat 5, a main body 6, an electroplated cover 7, a cover 8, and seal members between relative parts for water seal. For example, a seal ring is provided between the main body seat 4 and the rotation seat 5. The seal ring is a first O-shaped ring 51. A seal ring is provided between the cover seal seat 3 and the rotation seat 5. The seal ring is a second O-shaped ring 52. The seal rings are prior art and won't be described hereinafter. The cover unit 2 can be integrally formed with the cover seal seat 3 for compact configuration of the shower head.

In the first embodiment of the present invention, the shower head can be switched for different spray modes. When the water inlet 41 communicates with the second through hole 36, the water will pass the water inlet 41, the second through hole 36, the second water passage 32 and the second water outlet 22 in sequence to provide a second spray mode.

When the water inlet 41 communicates with the third through hole 37, the water will pass the water inlet 41, the third through hole 37, the third water passage 33 and the third water outlet 23 in sequence to provide a third spray mode.

When the water inlet 41 communicates with the first reverse flow hole 38, the blind hole 42 blocks the second through hole 36, the interval 44 covers the third through hole 37, the water passes the water inlet 41, the first reverse flow hole 38, the shift water passage 34 and the second reverse flow hole 39 to form two water flows. One water flow passes the interval 44, the third through hole 37, the third water passage 33 and the third water outlet 23, and the other water flow passes the first through hole 35, the first water passage 31 and the first water outlet 21. The shower head provides a mixed spray of the third spray mode and the first spray mod.

When the water inlet 41 communicates with the second reverse flow hole 39, the blind hole 42 blocks the third through hole 37, the interval 44 covers the first reverse flow hole 38, the water passes the water inlet 41, the second reverse flow hole 39, the shift water passage 34, the first reverse flow hole 38 and the interval 44 to form two water flows. One water flow passes the second through hole 36, the second water passage 32 and the second water outlet 22, and the other water flow passes the first through hole 35, the first water passage 31 and the first water outlet 21. The shower head provides a mixed spray of the second spray mode and the first spray mode.

When the water inlet 41 communicates with the first through hole 35, the water will pass the water inlet 41, the first through hole 35, the first water passage 31 and the first water outlet 21 in sequence to provide a first spray mode.

In the second embodiment of the present invention, the first spray mode, the third spray mode and the second spray mode are identical to the first embodiment with the exceptions described hereinafter. When the water inlet 41 communicates with the first reverse flow hole 38, the blind hole 42 blocks the third through hole 37, the water will passes the water inlet 41, the first reverse flow hole 38, the shift water passage 34 and the second reverse flow hole 39 to form two water flows. One water flow passes the second through hole 36, the second water passage 32 and the second water outlet 22, and the other water flow passes the first through hole 35, the first water passage 31 and the first water outlet 21. The shower head provides a mixed spray of the second spray mode and the first spray mod.

When the water inlet 41 communicates with the second reverse flow hole 39, the blind hole 42 blocks the first reverse flow hole 38. The water passes the water inlet 41 and enters the shift water passage 34 to be sealed in the shift water passage 34 so as stop spraying of the shower head.

Through the shift water passage 34 formed between the cover seal seat 3 and the cover unit 2 of the present invention, the water enters the cover seal seat 3 once again and flows to the unsealed through holes to achieve the mixed spray function. The present invention is simple in configuration and can be manufactured easily and may be applied to various structures for water outflow.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A water separation structure of a shower head, comprising a cover unit, a cover seal seat and a main body seal seat;

the cover unit having three water outlets which are a first water outlet, a second water outlet and a third water outlet; the cover seal seat being connected to the cover unit, three water passages and a shift water passage formed between the cover seal seat and the cover unit, the three water passages being a first water passage which communicates with the first water outlet, a second water passage which communicates with the second water outlet and a third water passage which communicates with the third water outlet;

the cover seal seat having five through holes which are disposed in a circle, the five through holes being a first through hole which communicates with the first water passage, a second through hole which communicates with the second water passage, a third through hole which communicates with the third water passage, a first reverse flow hole and a second reverse flow hole, the shift water passage communicating with the first reverse flow hole and the second reverse flow hole;

the main body seal seat being connected to the cover seal seat in a rotatable way, the main body seal seat having a water inlet and a blind hole which are spaced and located corresponding to the five through holes of the cover seal seat, the water inlet comprising a seal ring therein, the blind hole comprising a seal pad therein, the water inlet communicating with one of the five through holes of the cover seal seat by means of rotation to open the relative water passage, the blind hole being to block the other through holes and close the other water passages, the seal ring and the seal pad being against the cover seal seat;

seal members provided between relative parts for water seal.

2. The water separation structure of a shower head as claimed in claim 1, wherein a circumferential angle between the water inlet and the blind hole is equal to a circumferential angle of three of the five through holes, the water inlet and the blind hole respectively covering two spaced through holes, an interval between the water inlet and the blind hole covering the middle through hole.

3. The water separation structure of a shower head as claimed in claim 1, wherein a circumferential angle between the water inlet and the blind hole is equal to the circumferential angle of two of the five through holes, the water inlet and the blind hole respectively covering the two adjacent through holes.

4. The shower head structure as claimed in claim 1, wherein the water inlet and the blind hole each have a rim protruding from an outer edge thereof and a spring therein.

5. The water separation structure of a shower head as claimed in claim 1, wherein the cover seal seat has a positioning hole thereon and the main body seal seat has five positioning recesses, the positioning hole being provided with a positioning pin which slides among the five positioning recesses.

6. The water separation structure of a shower head as claimed in claim 1, wherein the cover unit is integrally formed with the cover seal seat.

* * * * *